US009809281B2

(12) United States Patent
Welch

(10) Patent No.: US 9,809,281 B2
(45) Date of Patent: Nov. 7, 2017

(54) SUBMERSIBLE BUOY, INFLATION CONTROL SYSTEM AND KIT

(71) Applicant: Glenn S. Welch, Belmont, NH (US)

(72) Inventor: Glenn S. Welch, Belmont, NH (US)

( * ) Notice: Subject to any disclaimer, the term of this patent is extended or adjusted under 35 U.S.C. 154(b) by 0 days.

(21) Appl. No.: 15/139,956

(22) Filed: Apr. 27, 2016

(65) Prior Publication Data

US 2016/0340001 A1 Nov. 24, 2016

Related U.S. Application Data

(60) Provisional application No. 62/163,084, filed on May 18, 2015.

(51) Int. Cl.
*B63B 22/22* (2006.01)
*B63B 22/06* (2006.01)

(52) U.S. Cl.
CPC ..... *B63B 22/22* (2013.01); *B63B 22/06* (2013.01)

(58) Field of Classification Search
CPC ..... B63B 22/02; B63B 22/06
See application file for complete search history.

(56) References Cited

U.S. PATENT DOCUMENTS 8,512,088 B2 * 8/2013 Jone ..... B63B 22/20 114/328
8,943,992 B1 * 2/2015 Petersen ..... B63B 22/023 114/256
2015/0225051 A1 * 8/2015 Dufour ..... B63G 8/22 701/21

* cited by examiner

*Primary Examiner* — Edwin Swinehart
(74) *Attorney, Agent, or Firm* — Michael J. Persson; Catherine Napjus; Lawson Persson & Chisholm

(57) ABSTRACT

A submersible buoy comprising a body defining a space; a gas compressor in fluid communication with a pressure vessel, where the gas compressor is capable of releasing gas from the pressure vessel into the space and of sucking gas out of the space into the pressure vessel; a battery that powers the gas compressor; and a controller in electronic communication with the gas compressor, where the controller controls the operations of the gas compressor.

20 Claims, 5 Drawing Sheets

SUBMERSIBLE BUOY, INFLATION CONTROL SYSTEM AND KIT

CLAIM OF PRIORITY

This application claims the benefit of priority of U.S. Provisional Patent Application Ser. No. 62/163,084 filed on May 18, 2015.

FIELD OF THE INVENTION

The present invention relates to marine buoys and, in particular, to an improved submersible mooring buoy.

BACKGROUND

Mooring systems are common marine floating devices and accessories and are often used to moor a watercraft in circumstances where docks are unavailable and/or the water in proximity of the desired mooring location is too shallow for the watercraft to safely navigate.

A conventional mooring system is shown in FIG. 1. This system includes a mooring buoy that floats on the surface of the water and identifies the location of the mooring. Beneath the visible buoyant portion are one or more chains or other flexible lines attached at on end to the submerged end of the buoy and at the other end to a heavy anchor, which sits on the floor of the body of water. These chains and anchor are often made of a great deal of valuable metal, such as stainless steel, that can cost in upwards of one thousand dollars to replace if stolen. In the system shown in FIG. 1, a pickup buoy is attached to a mooring line and allows for easy attachment of the line to the watercraft when in proximity of the mooring buoy. However, the use of a pickup buoy is optional and, for the reasons explained below, a pickup buoy is not used in connection with the present invention.

The floating top portion of the mooring buoy and the pickup buoy each advertises the location of valuable items to steal and resell without the perpetrator even having to break and enter. Therefore there is a need for a submersible buoy that may be hidden from sight when not in use, thus protecting it and its components from theft.

In addition to the risk of theft, when used in lakes and other bodies of fresh water in cold weather climates, traditional buoys must be removed from the water before these water bodies freeze, in order to prevent loss or damage. This typically occurs in late fall, when water temperatures begin to dip toward freezing, and early spring, when water temperatures begin to rise above freezing. These removals and placements often require diving to the bottom of the body of water to free the anchor in the fall and to set the anchor in the spring. As this is the case, boat owners often need to pay a diver to perform this task each year. Accordingly, rather than removing and replacing the buoy in the fall and spring, respectively, there is a need for a submersible buoy that may be submerged during winter months and floated to the surface once the body of water is free of ice.

Buoys may also act as obstructions to watercraft. Being able to submerge such buoys so that they are not in the way when not in use is another advantage of a submersible buoy. Finally, buoys often mark the location of lobster traps, crab pots, or other devices for catching seafood. Again, such buoys advertise the location of easily stolen seafood and equipment.

Some attempts have been made to design submersible buoys, but each has substantial drawbacks. U.S. Pat. No. 2,546,956 to Yeomans, for example, discloses a submersible buoy. The submersible buoy disclosed therein will sink with the bleeding of air through an opening or rise with a supply of compressed air. Unfortunately, the compressed air is supplied from shore mounted compressors through hose lines. The buoy must therefore be tethered through hose lines. This makes the apparatus not only unwieldy, but likely traceable or otherwise locationally identifiable even when submerged.

International Application No. PCT/AU98/00227 also discloses a submersible and retrievable buoy. This buoy includes a length of rope wound around a spool-shaped body, with one end of the length affixed to the body and one end affixed to an anchor of sorts, such as a crab pot. A free portion of the rope is tied or otherwise securely fastened to a rope shackle pin. When the body is submerged, the rope shackle pin is retained between jaws disposed on the buoy body. When the body is retrievable at the surface of the water, the rope shackle pin is released from the jaws. The release of the pin from the jaws allows the rope wound around the buoy body to unravel so that the buoy body may float to the surface. The retention of the pin in the jaws does not allow this unraveling so that the rope remains wound around the body and close to the anchor. The buoy includes a signal receiver configured to receive a remotely transmitted signal containing information about when the rope release apparatus is desired to be actuated. The signal can be initiated by either a controller or by a timer. Although this buoy represents a significant improvement over other prior art, it relies upon mechanical components that are prone to malfunctioning and failure, especially in environments in which ice and other contaminants are allowed to build upon the rope.

SUMMARY OF THE INVENTION

The present invention is a submersible buoy, an inflation control system for submersible buoys and a submersible buoy kit.

In its most basic form, the submersible buoy comprises a substantially flexible inflatable body defining a space filled with a gas, such as air, at a desired pressure. An inflation control system is disposed within the space within the inflatable body. The inflation control system includes a gas compressor in fluid communication with a pressure vessel, a battery electrically connected to the gas compressor such that the battery powers the gas compressor, and a controller in electronic communication with the gas compressor such that the controller controls the operations of the gas compressor.

The body of the submersible buoy is manufactured from a flexible material, such as vinyl. The body is similar in all respects to inflatable buoys sold by manufacturers such as Taylor Made, Gladiator, Turtlepac, and others. The body may be of any size or shape, although a substantially spherical buoy having a twenty inch diameter is preferred. The preferred buoy is not perfectly spherical because it includes at least a mooring end for attaching a line to the buoy, that includes attachment means such as a loop, and may include some flattened areas, such as an attachment panel, which a true sphere would not include. The pressure vessel in fluid communication with the gas compressor of the inflation control system is preferably integrated into the gas compressor and is capable of generating approximately 40 PSI of suction pressure. The pressure vessel may be, for example, a pneumatic cylinder. The gas compressor is operable to compress the gas from the space into the pressure vessel when the buoy is to be submerged and to release gas from the pressure vessel when the buoy is to be returned to the surface. The space within the body of the buoy is a closed system and, by compressing gas into the pressure vessel, the pressure exerted by the gas on the inside walls of the body is decreased, causing the buoy to lose buoyancy and sink. Releasing that same gas causes the pressure exerted by the gas on the inside walls of the body to increase, causing the buoy to gain buoyancy and rise to the surface. The operation of the buoy is therefore founded on the displacement of air volume, which changes the density of the space within the body of the buoy. When the preferred buoy is fully buoyant, the space is filled with air. When the preferred buoy is fully submerged, almost all of the air is drawn into the pressure vessel so that the volume of air remaining is very low.

The battery powers both the release of gas from the pressure vessel of the gas compressor into the space and the compression of the gas from the space by the gas compressor into the pressure vessel. Preferred embodiments of the buoy include a photovoltaic panel or cell disposed on the outside of the body that feeds energy into the battery, or other electrical storage device, when the buoy is floating and exposed to sunlight. Alternatively, in some embodiments, at least the exposed end of the body is transparent or translucent and the photovoltaic panel or cell is disposed within the space. The light is able to come through the body to supply the photovoltaic panel. This embodiment may be preferable so as to protect the photovoltaic panel from the elements. Such embodiments where at least the exposed end of the body is transparent or translucent may also include an indicator light that is visible from outside of the body of the buoy. This indicator light may act as a beacon to aid in locating the buoy at night.

In some embodiments, the body of the submersible buoy also includes an attachment panel for attaching the inflation control system to the buoy within the space. This panel must be airtight and watertight sealable, even considering that the buoy will deform as gas is removed from the space and stored within the pressure vessel and again as the gas is released back in to the space.

It is preferred that the controller be remotely operable by a remote control. The remote control may be a dedicated handheld device that is software programmed for communication with the controller. Alternatively, the remote control may be another device, such as a phone or computer, where software has been downloaded onto the device so that it may act in the capacity of a remote control for this purpose.

In some embodiments, however, the controller may also or instead be controllable by a user interface disposed on the body and/or on the controller itself. The user interface may be included on the attachment panel, for example. It is preferred that the controller include GPS capabilities so that the location of the buoy may be determined even when the buoy is submerged. Alternatively, the buoy may include a GPS-capable device separate from the controller.

In its most basic form, the submersible buoy kit of the present invention includes the submersible buoy of the present invention, an anchor, and a flexible line connecting the buoy and the anchor. The flexible line may be any rope, chain, or line commonly used for such purposes in the art. The anchor may be any heavy device that is attachable to the flexible line and will remain relatively stationary when settled on the seabed. The kit may also include a seafood trap attachable to the buoy, the anchor, or the flexible line. The seafood trap may be a lobster pot, a crab pot, a fish net or trap, or any other type of trap commonly used in the art of catching and trapping seafood.

The submersible buoy kit may also include a dedicated handheld remote control. Alternatively, the submersible buoy kit may include downloadable software that, when in installed on a data processing device, such as a phone or computer, will cause that device to act as a remote control for the controller of the submersible buoy. This downloadable software may be made available in the kit in a physical form, such as a CD, or may be downloadable from the internet.

These aspects of the present invention are not meant to be exclusive and other features, aspects, and advantages of the present invention will be readily apparent to those of ordinary skill in the art when read in conjunction with the following description and accompanying drawings.

DETAILED DESCRIPTION

Figure 1:
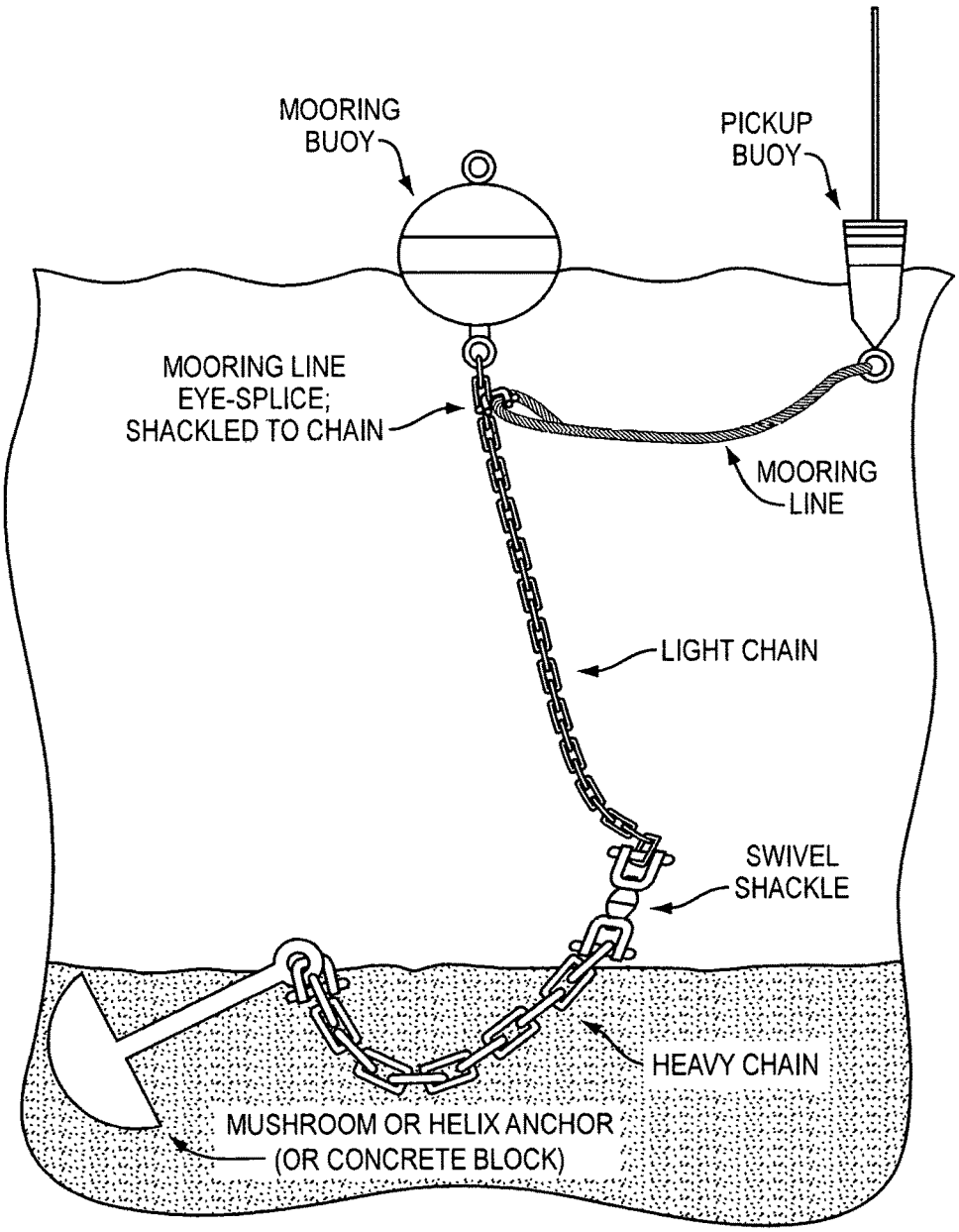
FIG. 1 (PRIOR ART)
FIG. 1 is a diagrammatic view of a prior art buoy system.
Figure 2:
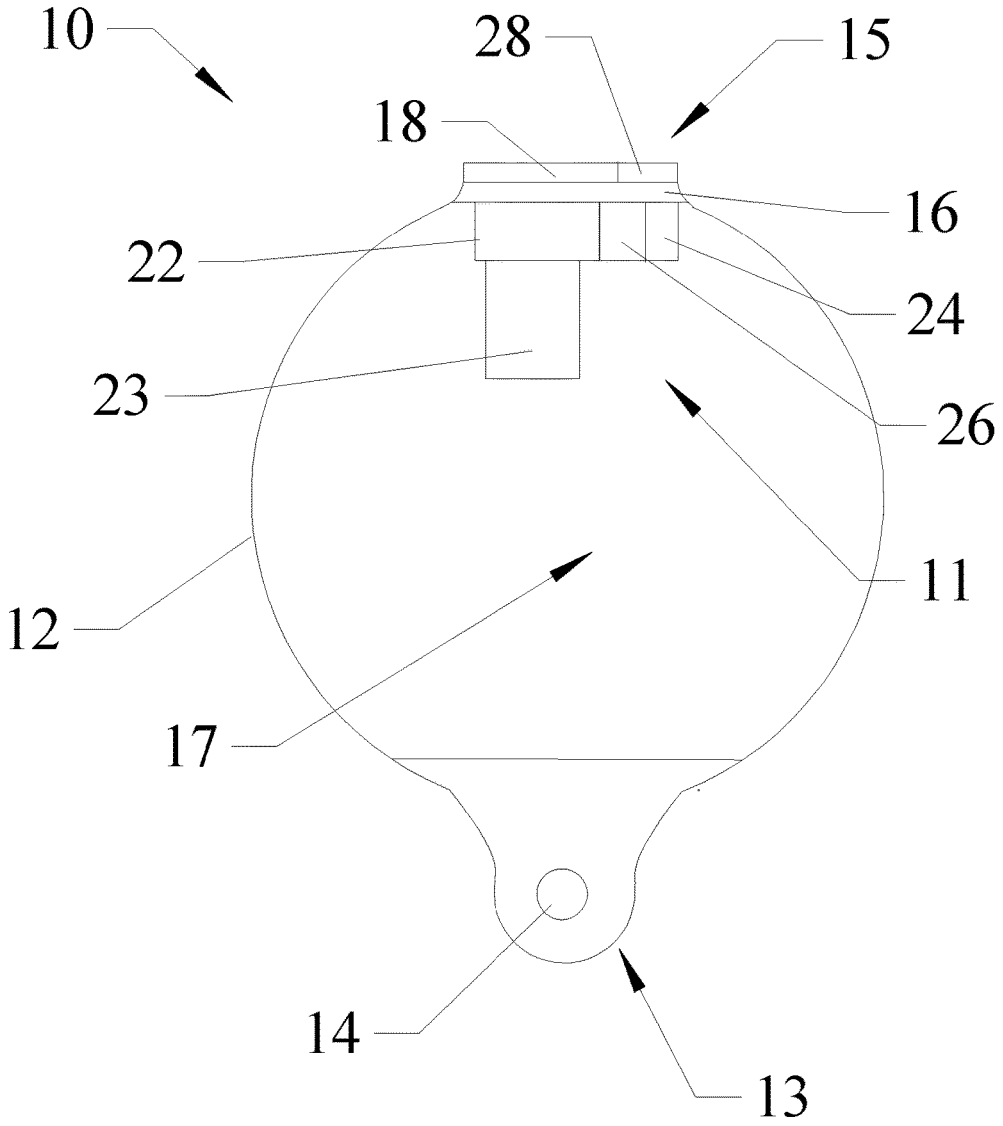
FIG. 2 is cut way front view of one embodiment of the submersible buoy of the present invention showing the inflation control system within the space defined by the body of the buoy.

Referring first to FIG. 2, a front view of one embodiment of the submersible buoy 10 is provided. Buoy 10 is made up of a body 12, a mooring end 13, and an exposed end 15. In the embodiment of FIG. 1, the inflation control system 11 is disposed proximate the exposed end 15, but is deposed proximate the mooring end 13 in other embodiments. It is understood that, whether buoy 10 is submerged or floating, mooring end 13 is always in the water. Exposed end 15, on the other hand, will be out of the water and exposed to the air and elements above the water line when buoy 10 is floating and not submerged.

Body 12 is a manufactured from a flexible material, such as vinyl. Body 12 is shown with a traditional round buoy shape, but it is understood that the shape of body 12 may be any shape. In addition, body 12 may be constructed of any materials commonly used in the art of buoy manufacturing, such as vinyl, plastic, or rubber. Importantly, the material out of which buoy 10 is constructed should be able to withstand the deformation that may occur when gas is removed from space 17 into the pressure vessel 23 of the gas compressor 22. Although the body 12 may be of any size or shape, a substantially spherical buoy 10 having a diameter of between eight and thirty six inches is preferred.

Figure 5A:
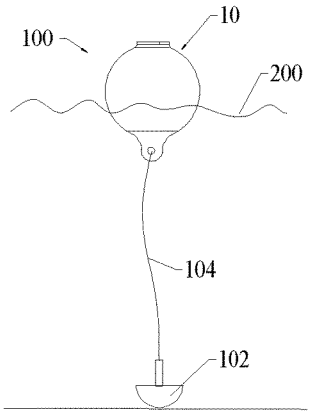
FIGS. 5A-5C are views of the assembled submersible buoy kit of the present invention in various states of submersion.
Figure 5B:
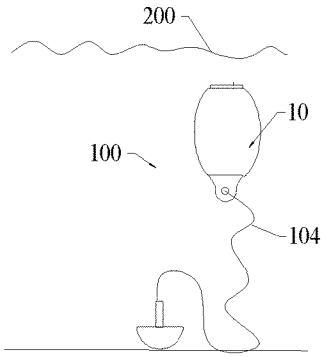
Figure 5C:
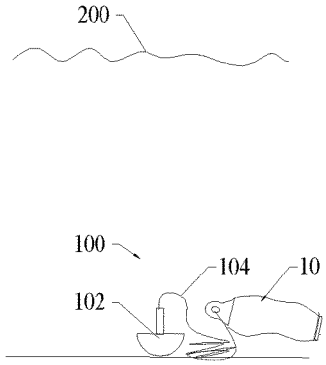

Mooring end 13 is preferably a reinforced molded end unit manufactured of a material that will withstand the forces exerted on the buoy 10 by the mooring line (shown in FIGS. 5A-5C). Mooring end 13 includes a line hole 14 therethrough that is shaped and dimensioned to allow conventional mooring lines and shackles to pass therethrough. In operation, mooring end 13 will be disposed within the water even when buoy 10 is fully inflated. Body 12 and mooring end 13 are identical in all respects to inflatable buoys sold by manufacturers such as Taylor Made, Gladiator, Turtlepac, and others.

Exposed end 15 is disposed at the opposite end from the mooring end 13 and will be exposed above the surface of the water when buoy 10 is fully inflated. In the embodiment of FIG. 2, exposed end 15 includes an airtight attachment panel 16 that allows the inflation control system 11 to be mounted to the body 12 of the buoy 10. The attachment panel 16 is preferably manufactured of the same reinforced molded material as the mooring end 13, and includes an airtight and watertight seal to seal the body 12 when the inflation control system 11 is mounted thereon.

Inflation control system 11 controls the pressure of the gas within space 17 defined by the body 12. The inflation control system 11 includes a gas compressor 22 in fluid communication with a pressure vessel 23. Gas compressor 22 preferably also includes an integral gas valve 27 (see FIG. 4), which is in fluid communication with the space 17 within the body 12. Gas compressor 22 causes air to move between pressure vessel 23 and space 17 through gas valve 27, depending on whether gas valve 27 is opened or closed. However, other embodiments may include a separate gas valve. Battery 24 is electrically connected to the gas compressor 22 through a controller 26. The controller 26 provides power from the battery 24 to the gas compressor 22 and controls the operation of the gas compressor 22 and gas valve 27.

The gas compressor 22 is operable to compress gas from the space 17 into the pressure vessel 23 when the buoy 10 is to be submerged and to release gas from the pressure vessel 23 when the buoy 10 is to be released to the surface. This latter function of releasing gas from pressure vessel 23 is achieved through opening valve 27, which is controlled by controller 26. The space 17 within body 12 of the buoy 10 is a closed system and, by compressing gas into the pressure vessel 23, the pressure exerted by the gas on the inside walls of the body 12 is decreased, causing the buoy 10 to lose buoyancy and sink. Releasing that same gas causes the pressure exerted by the gas on the inside walls of the body 12 to increase, causing the buoy to gain buoyancy and rise to the surface.

Figure 3:
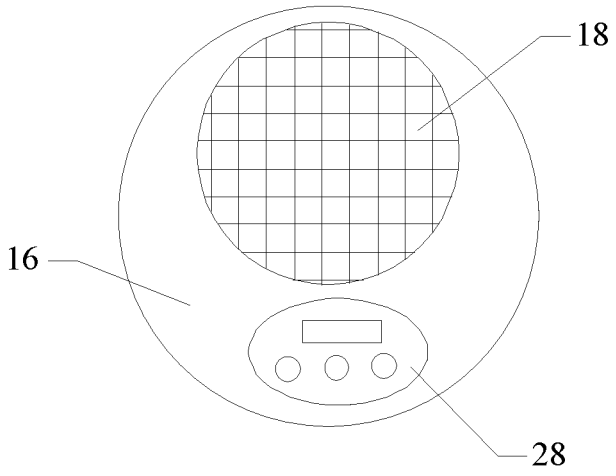
FIG. 3 is a top view of the preferred embodiment of the attachment panel showing the photovoltaic panel and user interface.

As shown in FIG. 3, the preferred embodiment includes attachment panel 16 to which a photovoltaic panel 18 and user interface 28 are attached. Photovoltaic panel 18 is any panel, cell, or series of cells that convert the energy of light into electricity by the photovoltaic effect. Photovoltaic panel 18 absorbs light when buoy 10 is not submerged and is in electronic and/or electrical communication with at least battery 24 (shown in FIG. 2) disposed within space 17. As such, the electricity produced through photovoltaic panel 18 may be used to at least partially power gas compressor 22 and/or charge battery 24.

The user interface 28 is in electronic communication with controller 26 and provides a user with the capability to program controller 26 from the outside of buoy 10, as explained in more detail below. In the embodiment shown, controller 26 may be programmed from the outside of buoy 10 through user interface 28 disposed on body 12. As discussed herein, it is understood that "inflation/deflation" means the release of compressed air from pressure vessel 23 (shown in FIG. 2) into space 17 and/or the sucking in of air from space 17 back into pressure vessel 23. The programming of controller 26 may include the simple activation of the inflation/deflation functions in real time. The programming may also include the desired timing for the inflation/deflation of buoy 10 and/or the desired level of inflation/deflation, i.e. the desired depth (or surface) at which the user wishes buoy 10 to be disposed. The desired timing may include the date and time of an inflation/deflation and/or an amount of time that buoy 10 is intended to remain in the desired state and depth. In embodiments of buoy 10 where controller 26 has access to water temperature information, either through a temperature sensor integral to buoy 10 and in electronic communication with controller 26 or through information provided to controller 26 wirelessly, the programming may also include a water temperature below or above which deflation or inflation may occur. Other events may also be included in the programming. It is understood that herein, references to "programming" or "operational programming" of inflation/deflation refer to any such programming as described above. It is understood that references to "software programming" in relation to a remote control, as described below, are unrelated to this "programming" of inflation/deflation.

The most simple version of user interface 28 will include controls to inflate or deflate buoy 10, i.e. to release air from pressure vessel 23 or suck air into pressure vessel 23, respectively. More advanced versions of user interface 28 may also include controls for additional programming beyond inflation and/or deflation of buoy 10, such as for the functions as described above. User interface 28 may also include an indication of the location of buoy 10 if controller 26 includes GPS capabilities, an indication of depth of buoy 10, and other controls, settings, or views.

In other embodiments, the user interface 28 is included directly on controller 26, which is programmed to the user's specifications at the factory or through other art recognized means. In other embodiments, a user interface 28 is included both on body 12, as shown, and directly on controller 26, and either may be used for such programming. As such, although controller 26 is depicted within buoy 10 in FIG. 1, it is understood that controller 26 may be partially or entirely disposed on the outside of buoy 10, so long as controller 26 is in communication with gas compressor 22 within space 17 on the inside of buoy 10. In addition, battery 24 is depicted within space 17, but it to may be partially or entirely disposed on the outside of buoy 10, so long as it is connected to gas compressor 22 such that battery 24 may power gas compressor 22. In some embodiments where controller 26 and/or battery 24 are at least partially disposed on body 12, these features may be incorporated into attachment panel 16.

In the preferred embodiment, which may or may not also include such a user interface 28 or user interfaces, controller 26 is remotely operable. This remote operation may be through any type of commonly used remote control. The remote control may be a dedicated handheld device that is software programmed in advance for communication with the controller. The remote control may also be another device, such as a smart phone, that is software programmed with software that allows the phone to act as a remote control so that it may control and communicate with controller 26 without a physical tether through wireless technology, such as that marketed under the trademark BLUETOOTH. It is preferable that this communication be capable even when buoy 10 is submersed. The operation of controller 26 may be in real time or preset. It is preferable that controller 26 include GPS capabilities so that the location of buoy 10 may be determined even when buoy 10 is submerged. Alternatively, the buoy 10 may include a GPS-capable device separate from the controller 26.

Figure 4:
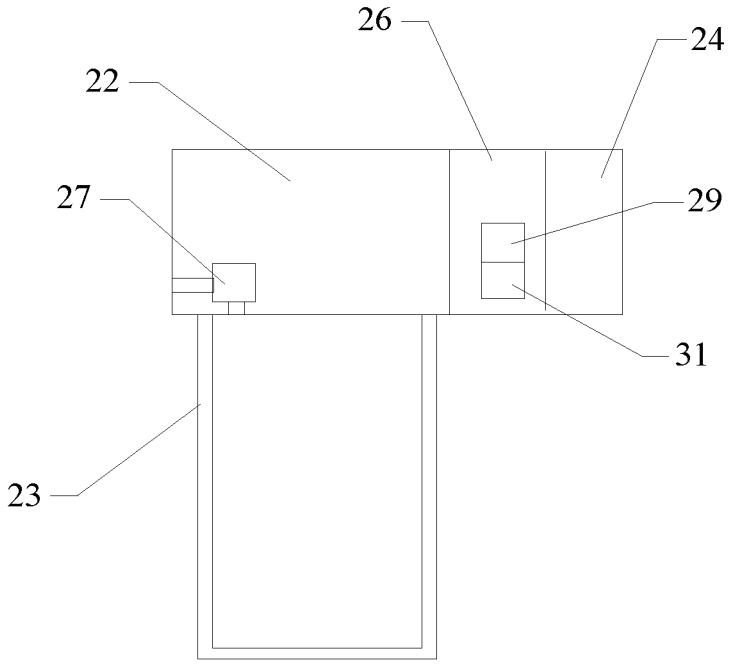
FIG. 4 is a diagrammatic view of one embodiment of the inflation control system of the present invention.

FIG. 4 shows the basic embodiment of the inflation control system 11. As was the case with the embodiment of FIG. 2, the basic inflation control system 11 includes a battery 24, controller 26, gas compressor 22, and pressure vessel 23. However, in this embodiment, there is no photovoltaic panel 18 or user interface 28. In addition, the controller 26 includes a microprocessor 29 and a memory 31 upon which the operational programming is stored. In this embodiment, it is preferred that the valve 27 be adapted to automatically open when there is insufficient power in the battery 24, so as to cause the buoy 10 to rise to the surface when the battery 24 is dead.

Now referring to FIGS. 5A-5C, submersible buoy kit 100 is shown and submersible buoy 10 is shown in various states of submersion. Submersible buoy kit 100 includes buoy 10, anchor 102, and flexible line 104. Buoy 10 is connected to anchor 102 through flexible line 104.

In FIG. 5A, buoy 10 is floating on the surface 200 of water as does any buoy. In this state, air has been released by gas compressor 22 from pressure vessel 23 into space 17 so that buoy 10 is buoyant.

In FIG. 5B, a portion of the air that was held within space 17 in FIG. 5A has been sucked by gas compressor 22 into pressure vessel 23 so that buoy 10 is suspended beneath the surface of the water and out of sight from above that surface. This view may also indicate progress of buoy 10 on its way down to the seabed, as shown in FIG. 5C, or on its way up from a greater depth to the surface, as shown in FIG. 5A. Note that body 12 of buoy 10 is deforming inward as air pressure within space 17 decreases and buoy 10 becomes less buoyant.

In FIG. 5C, all or almost all of the air held within space 17 has been sucked into pressure vessel 23 so that buoy 10 rests on the seabed. It is up to the user whether it is preferably for buoy 10 to be in a state as shown in FIG. 5B, below the water surface but not sunk to the seabed, or as shown in FIG. 5C, sunk entirely to the seabed, when submerged. The user may control this state through controller 26. Controller 26 will control the amount of air released into space 20 or sucked out of space 20 by gas compressor 22. This control will dictate the depth of buoy 10 when submerged.

It is understood that buoy 10 may not deform to the extent shown in FIGS. 5B and 5C when air is sucked into pressure vessel 23. The body 12 may be made of sufficiently rigid material that although the density of space 17 may decrease when air is sucked into pressure vessel 23, so that buoy 10 sinks, the body 12 maintains its general shape and appearance.

Figure 6:
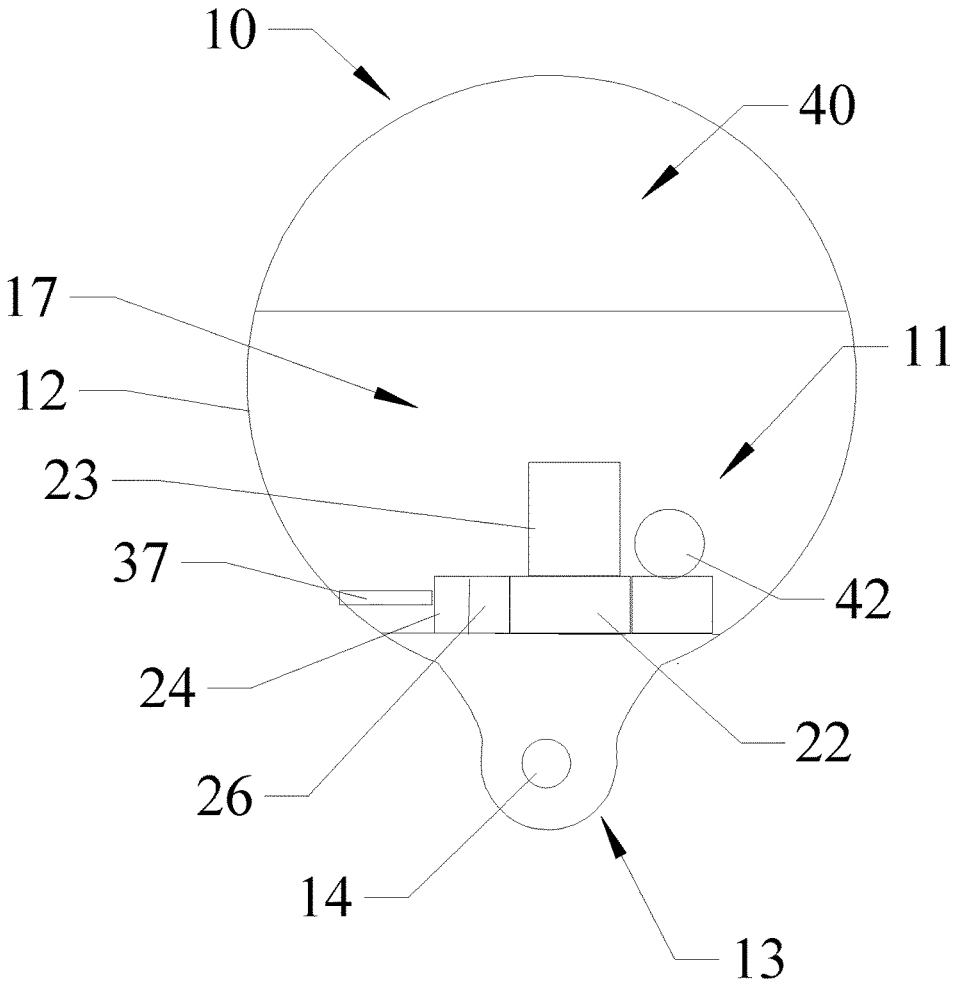
FIG. 6 is cut way front view of the preferred embodiment of the submersible buoy of the present invention showing the inflation control system within the space defined by the body of the buoy.

Referring now to FIG. 6, the preferred buoy 10 is shown. In the preferred buoy 20, the inflation control system 11 is disposed proximate the mooring end 13, which allows the inflation control system 11 to be easily retrofitted into conventional buoy manufacturing processes.

In the embodiment of FIG. 6, at least the exposed end of buoy 10 is made of transparent or translucent material 40 so that light is able to come through body 12 into space 17 and vice versa. In such embodiments, photovoltaic panel (not shown) may be disposed within space 17. In such embodiments with a transparent or translucent exposed ends 15, an indicator light 42 may also be included within space 17. The indicator light 42 may act as a beacon to aid in locating buoy 10. One of ordinary skill in the art will understand that the indicator light may be disposed on any of the hardware features disposed within the space 17, such as the outsides of gas compressor 22, pressure vessel 23, battery 24, or controller 26, or on an inner wall of the body 12.

Temperature sensor 37 is shown at mooring end 13. Temperature sensor 37 may be a thermocouple, or any other art recognized device that is capable of measuring the water temperature. Temperature sensor 37 is in electronic communication with controller 26 and provides water temperature information to controller 26. Buoy 10 may be programmed to inflate or deflate depending on the temperature of the water. I.e. in late fall, temperature sensor 37 may detect temperatures nearing freezing, which may cause controller 26 to instruct gas compressor 22 to suck air from space 17 into pressure vessel 23 so that buoy 10 sinks. Alternatively, in the spring, temperature sensor 37 may detect rising temperatures until the water temperature is above freezing, which may cause controller 26 to instruct gas compressor 22 to release air from pressure vessel 23 into space 17 so that buoy 10 rises. Temperature sensor 37 may be any commonly used in the art. One of ordinary skill in the art will recognize that temperature sensor 37 may be disposed differently upon body 12, while maintaining its functionality of water temperature measurement. Any of such embodiments are considered a part of the present invention.

Although the present invention has been described in considerable detail with reference to certain preferred versions thereof, other versions would be readily apparent to those of ordinary skill in the art. Therefore, the spirit and scope of the description should not be limited to the description of the preferred versions contained herein.

What is claimed is:

1. A submersible buoy comprising:

an airtight, watertight, flexible body defining a space, comprising:

a mooring end attachable to a mooring line; and an exposed end that faces away from water when said submersible buoy is floating; and an inflation control system disposed at least partially within said space, said inflation control system comprising:

a pressure vessel shaped and dimensioned to store compressed gas;

a gas valve in fluid communication with said pressure vessel and said space;

a gas compressor in fluid communication with said pressure vessel such that said gas compressor is capable of performing operations comprising:

releasing gas from said pressure vessel into said space; and sucking gas from said space into said pressure vessel;

a controller in electronic communication with said gas compressor and said gas valve such that said controller controls at least a position of said gas valve and said operations of said gas compressor; and a battery in electric communication with at least said gas compressor such that said battery powers said operations of said gas compressor.

2. The submersible buoy as claimed in claim 1, wherein said controller comprises at least a memory that stores programming of at least said operations of said gas compressor and a microprocessor in electronic communication with said memory and capable of executing said programming.

3. The submersible buoy as claimed in claim 2, wherein said programming further comprises timing of said operations of said gas compressor.

4. The submersible buoy as claimed in claim 2, wherein said body further comprises a temperature sensor in electronic communication with said controller and disposed at said mooring end such that said temperature sensor reads a water temperature and communicates water temperature information to said controller, and wherein said programming further comprises programming to use water temperature information as an indication of said timing of said operations of said gas compressor.

5. The submersible buoy as claimed in claim 1, wherein said body comprises at least one attachment panel, wherein said attachment panel is attached to said inflation control system and is attachable to said body such that said body remains sealed airtight and watertight when said attachment panel is in place.

6. The submersible buoy as claimed in claim 5, wherein said attachment panel comprises a user interface in electronic communication with said controller, wherein said user interface comprises controls such that a user is capable of programming at least said operations of said gas compressor through said user interface.

7. The submersible buoy as claimed in claim 1, wherein said body further comprises at least one photovoltaic panel in electric communication with said battery.

8. The submersible buoy as claimed in claim 1, wherein:

at least said exposed end of said submersible buoy is made of a material that allows light to travel through said body;

said submersible buoy further comprises at least one photovoltaic panel in electric communication with said battery; and said at least one photovoltaic panel is disposed within said space such that light from without said buoy travels through said exposed end and reaches said at least one photovoltaic panel.

9. The submersible buoy as claimed in claim 1, wherein:

at least said exposed end of said submersible buoy is made of a material that allows light to travel through said body; and said submersible buoy further comprises an indicator light disposed within said space such that illumination from said indicator light visible from without said buoy.

10. The submersible buoy as claimed in claim 1, wherein said body comprises a user interface in electronic communication with said controller, wherein said user interface comprises controls such that a user is capable of programming at least said operations of said gas compressor through said user interface.

11. The submersible buoy as claimed in claim 1, further comprising a remote control, wherein said remote control is in wireless communication with said controller and comprises a user interface comprising controls such that a user is capable of programming at least said operations of said gas compressor through said user interface.

12. The submersible buoy as claimed in 10, further comprising a GPS-enabled device, wherein:

said GPS-enabled device determines a location of said submersible buoy;

said GPS-enabled device is in wireless electronic communication with said user interface of said remote control; and said user interface of said remote control displays the location of said submersible buoy as determined by said GPS-enabled device.

13. An inflation control system for disposal within a buoy having an airtight, watertight, flexible body defining a space, said inflation control system comprising:

a pressure vessel shaped and dimensioned to store compressed gas;

a gas valve in fluid communication with said pressure vessel and said space;

a gas compressor in fluid communication with said pressure vessel such that said gas compressor is capable of performing operations comprising:

releasing gas from said pressure vessel into said space; and sucking gas from said space into said pressure vessel;

a controller in electronic communication with said gas compressor and said gas valve such that said controller controls at least a position of said gas valve and said operations of said gas compressor; and a battery in electric communication with at least said gas compressor such that said battery powers said operations of said gas compressor.

14. A submersible buoy kit comprising:

a submersible buoy comprising:

an airtight, watertight, flexible body defining a space, comprising:

a mooring end attachable to a mooring line; and an exposed end that faces away from water when said submersible buoy is floating; and an inflation control system disposed at least partially within said space, said inflation control system comprising:

a pressure vessel shaped and dimensioned to store compressed gas;

a gas valve in fluid communication with said pressure vessel and said space;

a gas compressor in fluid communication with said pressure vessel such that said gas compressor is capable of performing operations comprising:

releasing gas from said pressure vessel into said space; and sucking gas from said space into said pressure vessel;

a controller in electronic communication with said gas compressor and said gas valve such that said controller controls at least a position of said gas valve and said operations of said gas compressor; and a battery in electric communication with at least said gas compressor such that said battery powers said operations of said gas compressor;

an anchor; and a flexible line comprising a first end attached to said mooring end of said submersible buoy and a second end attached to said anchor.

15. The submersible buoy kit as claimed in claim 14, wherein said body of said submersible buoy comprises at least one photovoltaic panel in electric communication with said battery.

16. The submersible buoy kit as claimed in claim 14, wherein said body of said submersible buoy comprises a user interface in electronic communication with said controller, wherein said user interface comprises controls such that a user is capable of programming at least said operations of said gas compressor through said user interface.

17. The submersible buoy kit as claimed in claim 14, wherein said submersible buoy further comprises a remote control, wherein said remote control is in wireless communication with said controller and comprises a user interface comprising controls such that a user is capable of programming at least said operations of said gas compressor through said user interface.

18. The submersible buoy as claimed in 16, wherein said submersible buoy further comprises a GPS-enabled device, wherein:

said GPS-enabled device determines a location of said submersible buoy;

said GPS-enabled device is in wireless electronic communication with said user interface of said remote control; and said user interface of said remote control displays the location of said submersible buoy as determined by said GPS-enabled device.

19. The submersible buoy kit as claimed in claim 14, further comprising a seafood trap removably attachable to one of a group consisting of said submersible buoy, said flexible line, and said anchor.

20. The submersible buoy kit as claimed in claim 14, further comprising a software product tangibly stored on a non-transitory storage device, wherein said software product, when downloaded onto at least one data processing device, is configured to cause said at least one data processing device to act as a remote control in wireless communication with said controller of said submersible buoy, wherein said remote control comprises a user interface comprising controls such that a user is capable of programming said functions of said compression chamber of releasing compressed gas into said space and sucking gas from said space into said compression chamber.

* * * * *